US006488070B1

(12) United States Patent
Cox

(10) Patent No.: US 6,488,070 B1
(45) Date of Patent: Dec. 3, 2002

(54) SHOWER CURTAIN ASSEMBLY

(76) Inventor: Rochelle Cox, 29655 Somerset Dr., Southfield, MI (US) 48076

( * ) Notice: Subject to any disclaimer, the term of this patent is extended or adjusted under 35 U.S.C. 154(b) by 0 days.

(21) Appl. No.: 09/922,758

(22) Filed: Aug. 6, 2001

(51) Int. Cl.[7] ..... E06B 9/06
(52) U.S. Cl. ..... 160/84.01; 160/DIG. 6
(58) Field of Search ..... 160/84.01, 84.04, 160/38, 39, DIG. 6, 349.1, 405, 40; 4/558, 608, 610; 248/264

(56) References Cited

U.S. PATENT DOCUMENTS 2,247,260 A * 6/1941 Stone ..... 160/84.04
3,386,106 A * 6/1968 Clemens ..... 160/84.04
3,946,788 A * 3/1976 Van Muyen ..... 160/84.04
4,122,559 A * 10/1978 Kelly ..... 160/11 X
4,739,815 A * 4/1988 Altman ..... 160/84.01
4,777,673 A 10/1988 Patteson et al.
4,931,342 A * 6/1990 Tolbert et al. ..... 160/84.01
5,033,132 A 7/1991 Greenblatt
D348,371 S 7/1994 Judkins
5,448,786 A 9/1995 Anderson
5,701,940 A 12/1997 Ford et al.
5,794,281 A 8/1998 Shearon
6,059,004 A * 5/2000 Oskam ..... 160/84.04
6,276,002 B1 * 8/2001 Oschmann ..... 4/558

* cited by examiner

*Primary Examiner*—David M. Purol
(74) *Attorney, Agent, or Firm*—Law Offices of Chupa and Associates, P.C.

(57) ABSTRACT

A shower curtain assembly 10 which encloses a shower enclosure 20 and can be selectively and vertically raised or lowered. The shower curtain assembly 10 includes a support structure 11 which engages a pair of walls 24, 25 defining the shower enclosure 20, an elongated member 9 which is held by said support structure 11, a curtain 13 which is attached to said elongated member 9, and a weighted bottom member 14 which is attached to the bottom of curtain 13 and which selectively and sealingly engages the bottom surface of the shower enclosure 20.

14 Claims, 3 Drawing Sheets

SHOWER CURTAIN ASSEMBLY

FIELD OF THE INVENTION

The present invention generally relates to a shower curtain assembly and, more particularly, to a shower curtain assembly that is easy to install, which allows the shower curtain to be vertically raised and lowered and which has a weighted bottom member which selectively engages and seals the bottom of the shower stall, thereby preventing water from escaping the shower stall.

BACKGROUND OF THE INVENTION

Shower curtain assemblies are generally used in bathrooms which contain a bathtub or a shower stall. Shower curtain assemblies generally include a mounting rod, which extends between the walls on either side of the shower enclosure; a fabric curtain; and a series of rings, which connect the fabric curtain to the mounting rod, and allow the curtain to move freely across the length of the rod.

One of the primary purposes of a shower curtain assembly is to prevent water from escaping the shower enclosure. Prior shower curtain assemblies attempt to prevent water from escaping by substantially covering the opening of the shower enclosure. When the shower curtain is in a "closed" position, water spray travels down the length of the shower curtain to the bottom of the shower enclosure and flows out of the shower drain. Shower curtains are also intended to prevent water escaping from the shower enclosure around the sides of the shower curtains. Particularly, water spray reaches the walls defining the shower enclosure and the sides of the shower curtain are intended to prevent this water spray from escaping outside of the shower enclosure.

A shower curtain is generally hung from a rail installed near the top of the shower entrance, at a length that allows it to be "tucked" into the shower tub. Particularly, the shower curtain can be moved horizontally to either side of the shower entrance, allowing the user to enter the shower enclosure. After entering, the user is required to move the shower curtain again, in the reverse direction of the previous movement. Invariably, the shower curtain moves too far, creating a gap between the wall and the shower curtain. After some adjustment, the curtain is positioned so that it is in close proximity to the wall on either side, but typically, the curtain cannot be positioned close enough to the wall to prevent water from escaping from the shower enclosure.

One of the drawbacks of these prior shower curtains is that the bottoms of the curtains have little or no means to sealingly engage or contact the tub, thereby allowing water to escape from the shower enclosure. For example and without limitation, the bottom of these shower curtains can move outside of the shower enclosure during use, thereby undesirably allowing water to run down the curtain and outside of the shower enclosure. This condition creates a hazard, as the water may accumulate on the floor outside the shower enclosure, creating a risk of a fall when a user exits the enclosure. Additionally, the water may damage the surrounding floors and walls.

Another drawback to these shower curtains is their inability to prevent water from escaping the shower enclosure from "around" the shower curtain sides. Depending on the size of the shower curtain, a large or small amount of material may accumulate at the sides of the shower enclosure. This accumulation of material is generally ineffective in preventing water from escaping. The movement of the shower curtain on the elongated rod compounds this problem. The shower curtain inevitably slides too far in one direction, resulting in an open space, where water is free to escape the shower enclosure.

Yet another drawback to these shower curtains is their inability to allow complete access to the shower enclosure. These shower curtains must slide to either end of the shower enclosure, on the elongated support rod. At either end, the shower curtain material accumulates and does not allow entry at that end. The shower user must enter the enclosure through the remaining space available in the entrance, however small that space may be.

There is therefore a need for a shower curtain assembly which overcomes the drawbacks of the prior art and which substantially prevents water from escaping the shower enclosure. There is further a need for a shower curtain assembly which overcomes the disadvantages of the prior art and which may be vertically retracted, allowing full access to the shower enclosure and then deployed to sealingly engage the bottom of the entrance to the shower enclosure.

Applicant's invention addresses these drawbacks associated with prior shower curtain assemblies and provides a new and useful shower curtain assembly having improved operability and water sealing characteristics.

SUMMARY OF THE INVENTION

It is therefore a first non-limiting advantage of the present invention to provide a shower curtain assembly which overcomes the previously delineated disadvantages of the prior art and selectively seals a shower enclosure.

A second non-limiting advantage of the invention is that it provides a shower curtain assembly which overcomes the previously delineated disadvantages of the prior art and which allows the shower curtain to be raised or lowered vertically, thereby enabling the entire shower enclosure to be utilized.

A third non-limiting advantage of the invention is that it provides a shower curtain assembly which overcomes the previously delineated disadvantages of the prior art and includes a magnetic, weighted bottom member which selectively and sealingly engages the bottom of the shower enclosure, thereby preventing water from escaping.

A fourth non-limiting advantage of the invention is that it provides a shower curtain assembly which overcomes the previously delineated disadvantages of the prior art and which includes a mechanism for selectively raising and lowering the shower curtain by the use of at least one cord which is attached to the mechanism.

A fifth non-limiting advantage of the invention is that it provides a shower curtain assembly which overcomes the previously delineated disadvantages of the prior art and includes a shower curtain which is supported by an elongated support member which includes an integrated raising/lowering mechanism and which is also resistant to mildew and bacteria.

According to one aspect of the present invention a shower curtain assembly is provided and selectively seals a shower enclosure. The shower curtain assembly includes an elongated member which is adapted to be coupled to a top portion of a shower enclosure; a fabric material which is coupled to said elongated member and which is adapted to selectively enclose said shower enclosure; a weighted bottom member which is substantially coextensive with said elongated member, which is coupled to said fabric material and which provides tension to said fabric material, said bottom member having a generally flat bottom surface which selectively and sealingly engages a horizontal surface which defines a bottom of said shower enclosure, thereby substantially preventing water from escaping from said shower enclosure; and at least one cord which is attached to said weighted bottom member and which passes through said fabric material, said at least one cord being effective to selectively and vertically raise and lower said bottom member and said fabric material.

According to a second aspect of the present invention a shower curtain assembly is provided. The shower curtain assembly is designed to be installed in a shower enclosure by an elongated member, which can selectively be adapted to fit various shower enclosures. The elongated member supports the operating mechanism which allows the shower curtain to be vertically raised and lowered. The operating mechanism further allows the shower curtain to be selectively stopped at any position and held in place, until the user selectively allows the curtain to be repositioned.

According to the third non-limiting aspect of the present invention, a shower curtain assembly is provided. The shower curtain assembly includes a magnetic and/or weighted bottom member which selectively seals the bottom surface of the shower enclosure. The bottom member is designed to prevent water from escaping from the tub enclosure and to ensure a "clean" look to the shower curtain and enclosure combination.

Further objects, features, and advantages of the present invention will become apparent from a consideration of the following description and the subjoined claims, when taken in conjunction with the accompanying drawings.

DETAILED DESCRIPTION OF THE INVENTION

Figure 1:
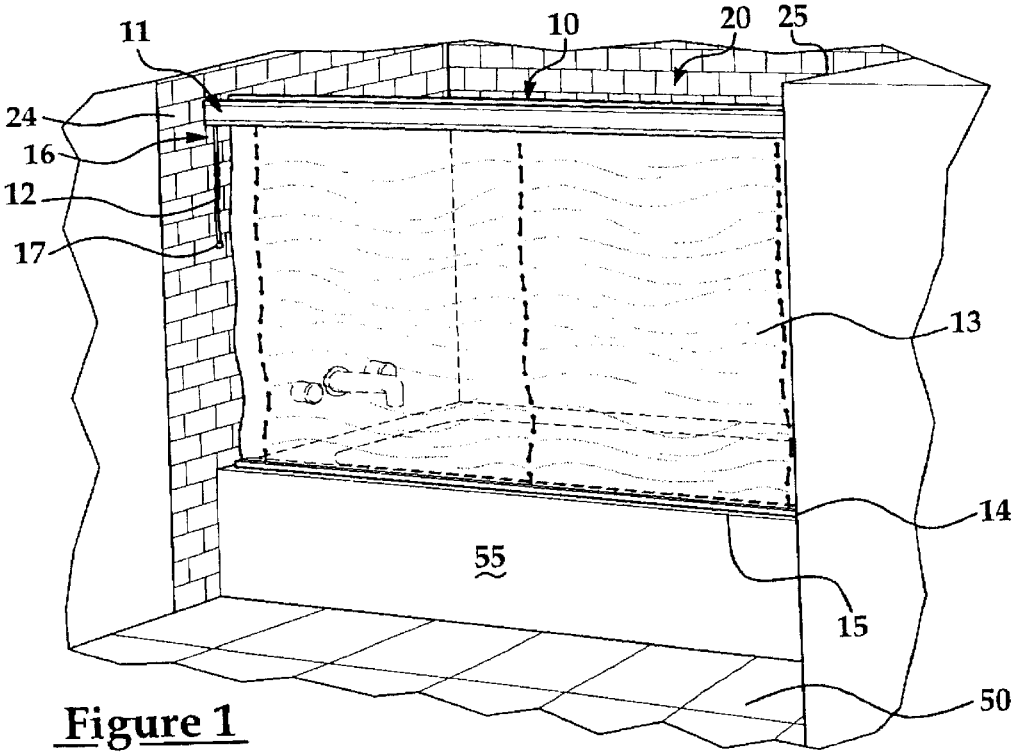
FIG. 1 is a perspective view of the shower curtain assembly, installed in a shower enclosure, and disposed in a fully lowered or "closed" position.

Referring now to FIGS. 1–5, there is shown a shower curtain assembly 10, which is installed within and substantially covers or encloses a shower space or enclosure 20, and which is made in accordance with the teachings of the preferred embodiment of the invention. While the present invention is described in use with a tub-type shower enclosure, it should be appreciated that it may be used with any type of shower and/or shower enclosure, including a "stand alone" type shower.

As shown, shower curtain assembly 10 includes an elongated support structure or assembly 11 which, as will be appreciated by those of ordinary skill in the art, selectively and frictionally engage shower enclosure walls 24, 25, thereby supporting the curtain assembly 10 at a certain height above the floor 50 or above the surface 30 of tub 55 which defines the bottom surface of the shower enclosure 20. Assembly 10 further includes an elongated and generally rectangular member 9 which is operatively disposed within and is retained and/or supported by support structure 11, a curtain 13 which is substantially coextensive with and which is coupled to elongated member 9, a bottom member 14 which is coupled to the bottom of curtain 13, and an operating mechanism 16 for selectively raising and lowering curtain 13.

Figures 4, 5:
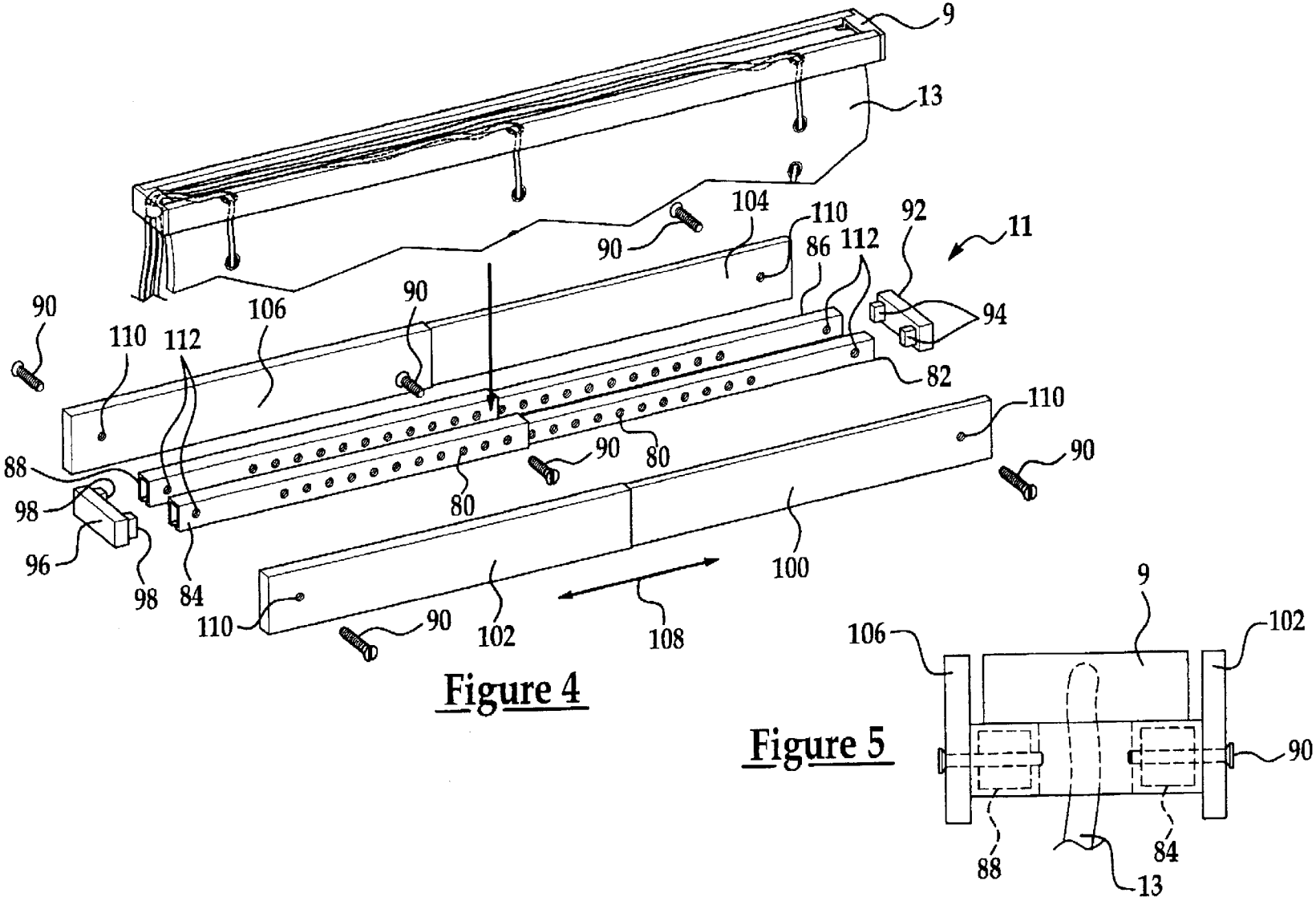
FIG. 4 is an exploded view of the support assembly used to attach the shower curtain assembly to the shower enclosure.
FIG. 5 is an end view of the shower curtain assembly shown in FIG. 1.

As best shown in FIG. 4, support assembly 11 includes a pair generally tubular telescoping members 82, 84 and 86, 88 which include several threaded apertures 80 which are adapted to receive conventional fasteners 90, thereby allowing members 82, 84 and 86, 88 to be selectively adjusted and fixedly coupled together at a desirable length (e.g., at a length substantially equal to the length between the walls 24, 25 of shower enclosure 20). Particularly, tubes 82 and 86 are respectively and slidably engaged within tubes 84 and 88 and are movable in the directions of arrows 108, effective to adjust the length of assembly 11. The hollow ends of telescoping members 82 and 86 are adapted to receive protruding portions 94 of resilient (e.g., rubber) member 92, thereby allowing member 92 to be selectively coupled to one end of the support assembly 11. The hollow ends of telescoping members 84 and 88 are adapted to receive protruding portions 98 of resilient (e.g., rubber) member 96, thereby allowing member 96 to be selectively coupled to one end of the support assembly 11. Resilient members 92, 96 are effective to frictionally engage walls 24, 25 of shower enclosure 20, thereby supporting assembly 11 at a desired and/or predetermined height above surface 30 or floor 50. When assembled, elongated member 9 rests upon and is supported by the telescoping members 82, 84 and 86, 88, as shown best in FIG. 5. Support assembly 11 further includes a pair of selectively expandable decorative telescoping panels 100, 102 and 104, 106. Panels 100, 102 and 104, 106 are selectively adjustable in length (e.g., in the directions of arrows 108) and are selectively and respectively attached to members 82, 84 and 86, 88 by use of conventional fasteners 90. Particularly, threaded apertures 110 which are formed at the ends of members 100, 102 and 104, 106 and threaded apertures 112 which are formed near the ends of members 82, 84 and 86, 88 receive fasteners 90, effective to secure the decorative panels 100, 102 and 104, 106 to the members 82, 84 and 86, 88. The outer surface of panels 100, 102 and 104, 106 may include an aesthetically-pleasing design or pattern. It should be appreciated that once panels 100, 102 and 104, 106 have been attached to members 82, 84 and 86, 88, the members 82–88 and the elongated member 9 are desirably concealed from view, thereby improving the overall aesthetic appearance of the assembly 10.

Member 9 is made from a lightweight, durable and water-resistant material, such as a plastic or metal material. Member 9 is generally hollow and includes an elongated inner cavity or channel 44, and an opening 41 which communicates with channel 44. In the preferred embodiment, the top side or edge of shower curtain 13 is substantially coextensive with and is attached in a conventional manner to elongated member 9, and the bottom side or edge of curtain 13 is substantially coextensive with and is attached to bottom member 14. In the preferred embodiment, curtain 13 is attached along its length to an inner surface of member 9 (e.g., a surface defining channel 44) by use of a plurality of conventional and commercially available fasteners (e.g., rivets, thread, or other conventional fasteners) (not shown). In an alternate embodiment, a rod is disposed within member 9 (e.g., within channel 44) and the top edge of curtain 13 is slidably attached to the rod by use of several rings, thereby allowing the curtain 13 to be moved, to a certain degree, laterally in the direction of arrow 72, as well as vertically in the directions of arrows 68, 70 (as shown in FIG. 3).

Curtain 13 includes several columns of rings 19 which are disposed within and/or are fixedly attached to curtain 13 and which extend from the top of curtain 13 to the bottom of curtain 13, effective to convey cords 12 from elongated member 9 to bottom member 14.

Operating mechanism 16 enables shower curtain 13 to be locked in various positions for access to the shower enclosure 20. In the preferred embodiment of the invention, operating mechanism 16 includes three drawstrings or cords 12, each of which terminates at a handle member 17. Cords 12 are made from a durable water resistant material such as nylon. As shown best in FIG. 3, cords 12 extend through elongated member 9, and each cord 12 weaves through shower curtain 13 through a column of rings 19 and terminates at weighted bottom member 14 (e.g., each of cords 12 is fixedly coupled to member 14).

Figure 3:
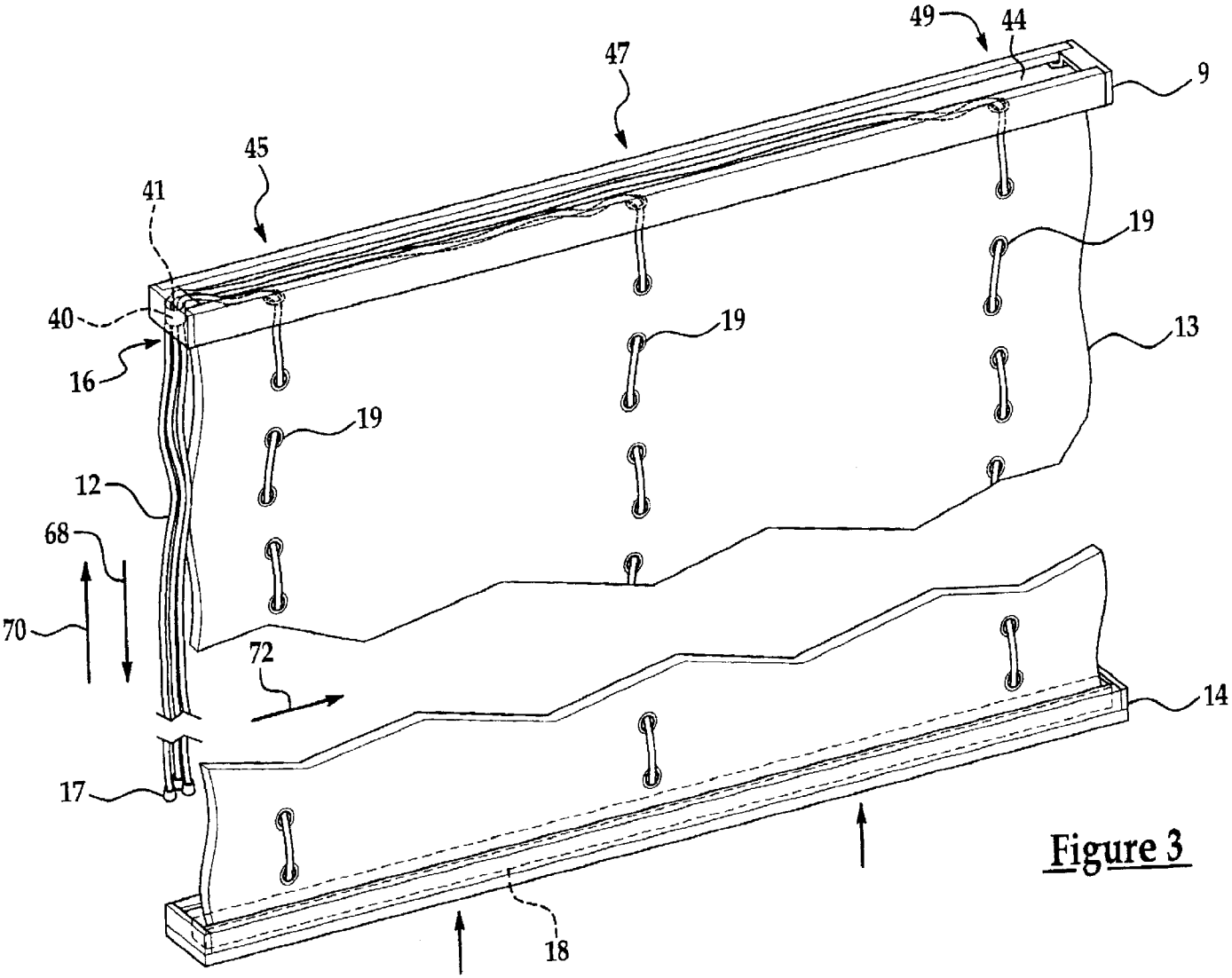
FIG. 3 is an enlarged fragmented view of the shower curtain assembly, illustrating the operating mechanism, inclusive cords, and weighted bottom member.

As shown best in FIG. 3, cords 12 pass through opening 41 and into inner channel 44 which houses cords 12. Each of cords 12 passes from channel 44 through a unique one of the columns 45, 47, and 49 or rings 19, thereby allowing cords 12 to raise and lower curtain 13 (e.g., the bottom of curtain 13 relative to elongated member 9.

In the preferred embodiment, operating mechanism 16 further comprises a locking/unlocking member 40, which alternatively allows the shower curtain 13 to be fixed in various vertical positions. In the preferred embodiment, member 40 includes one or more apertures which selectively receive and frictionally and/or compressingly engage each of cords 12. Particularly, member 40 compresses or frictionally engages cords 12 and may be selectively and temporarily fixed relative to cords 12, thereby allowing the cords 12 and curtain 13 to be held in a certain position. Particularly, as shown best in FIG. 3, when a user releases cords 12, the cords 12 will move in the direction of arrow 70 and will pass through opening 41 which allows cords to pass into channel 44. The cords 12 will continue to be drawn into channel 44 until member 40 reaches opening 41. Because member 40 is larger (e.g., has a larger diameter) than opening 41, member 40 will prevent cords 12 from being drawn any further into channel 44, thereby and holding curtain 13 and bottom member 14 in a desired vertical position. By applying a predetermined force to member 40 relative to cords 12, member 40 can be made to move relative to cords 12 and repositioned at a different location along cords 12, thereby allowing the curtain 13 to be held in different vertical positions. In other alternate embodiments, operating mechanism 40 may be replaced with other cord-type raising and lowering mechanisms, such as a spring-loaded operating mechanism.

In the preferred embodiment, weighted bottom member 14 is substantially coextensive with curtain 13 and member 9 and may include a metal bar or weighted member 18. Metal bar 18 provides weight and tension to the shower curtain 13, and in one non-limiting embodiment is coupled to each of cords 12. Member 14 further includes a generally flat bottom sealing surface 15 that selectively and sealing engages surface 30 of tub 55 that defines the bottom of the shower enclosure 20, effective to substantially prevent water from escaping from the shower enclosure. In the preferred embodiment, surface 15 comprises a flat magnetic surface which is magnetically attracted to metal structures, brackets and/or materials which are contained below and/or within and/or comprise tub surface 30 and thereby is sealingly coupled to surface 30 when curtain 13 is in a lowered or closed position (i.e., as shown in FIG. 1). In an alternate embodiment, bottom surface 15 includes a resilient rubber type sealing material which removably sticks to surface 30 by suction type forces, thereby sealing the shower enclosure 20 when curtain 13 is in a lowered or closed position.

In the preferred embodiment, curtain 13 is manufactured from a durable bacteria and mildew resistant fabric material. Shower curtain 13 is generally resilient and folds on itself as it retracts upward and unfolds as it is lowered downward. In the preferred embodiment, shower curtain 13 includes metallic rings 19, which are used to convey at least one cord 12 to bottom member 14. In one alternate embodiment, curtain 13 is formed from several different folding curtain panels which are coupled together in a conventional manner.

Figure 2:
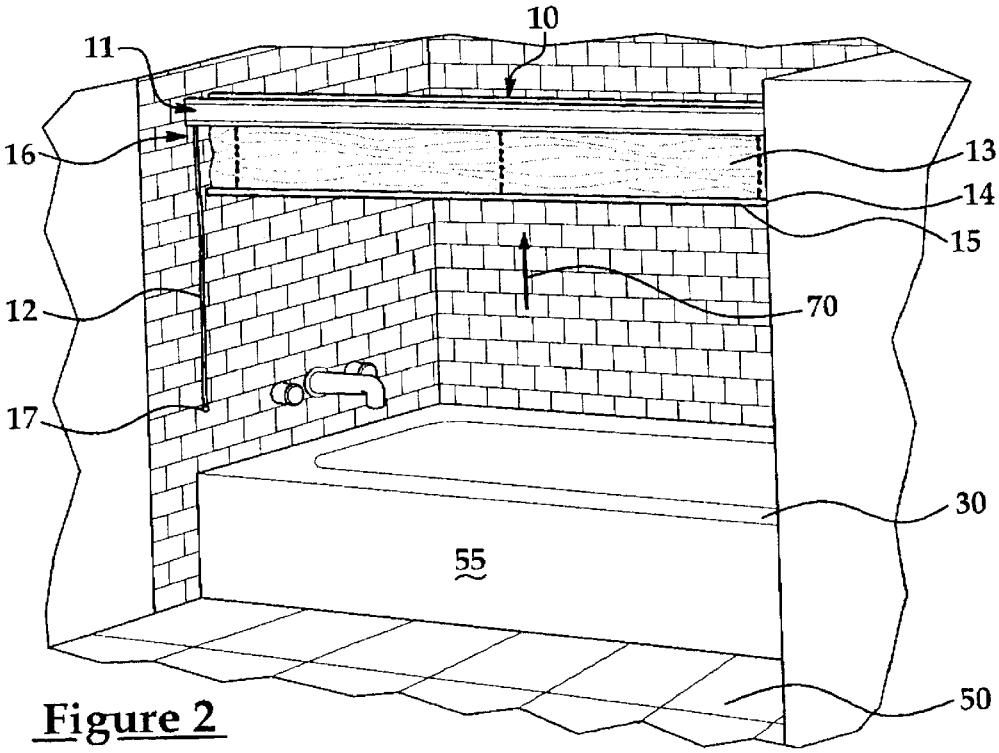
FIG. 2 is a similar view of the shower curtain assembly, shown in FIG. 1 and disposed in a partially raised or "open" position.

In operation, assembly 10 is installed in an appropriate shower enclosure with elongated support structure 11 firmly attached to walls 24, 25 which define the enclosure 20. Handles 17, which are connected to cords 12, are pulled downward to raise the shower curtain 13 (as shown in FIG. 2). Bottom member 14 may be initially manually disengaged from surface 30 by an operator, to reduce the stress applied to cords 12 and support member 11. A user may pull cords 12 downward in the direction of arrow 68 to raise curtain 13 in the direction of arrow 70. Once the curtain 13 is raised by a sufficient amount a user may enter enclosure 20, or may lock curtain 13 in a raised position by use of member 40 (i.e., by forcing member 40 upwards relative to cords 12 until it engages opening 41 of member 9).

Once a user desires to lower the curtain, the user may squeeze and/or otherwise disengage member 40 and slide it down relative to cords 12, while allowing the cords 12 to move upward as the weight of member 14 pulls curtain 13 downward. In response, shower curtain 13 will "close" or move downward. At any time during this downward movement, member 40 may be repositioned along cords 12 to prevent any further decent of shower curtain 13. Cords 12 control the movement of shower curtain 13, as they are directly connected to weighted bottom member 14 through elongated member 9 and pass through shower curtain 13 by way of a plurality of rings 19. By moving member 40 downward relative to cords 12, shower curtain 13 may continue its descent to shower enclosure bottom 30. Once weighted bottom member 14 contacts shower enclosure bottom 30, sealing surface 15 positively engages shower enclosure bottom 30 to prevent water from exiting the enclosure.

To retract the shower curtain 13, the bottom member 14 may be manually disengaged by a user, and the cords 12 are again pulled downward, thereby causing shower curtain 13 to be raised. Once shower curtain 13 reaches its maximum height, member 40 may be repositioned in a desired location, and cords 12 may be released, causing member 40 to lock shower curtain 13 in the selected position.

The foregoing shower curtain assembly 10 has many advantages over prior shower curtain assemblies. For example and without limitation, the novel operating system 16 and configuration of assembly 10 allows the shower curtain 13 to be raised or lowered vertically, thereby enabling the entire shower enclosure to be utilized. Furthermore, the novel magnetic, weighted bottom member 14 selectively and sealingly engages the bottom of the shower enclosure substantially along substantially the entire length of the enclosure bottom, thereby preventing water from leaking outside of the enclosure 20 from around the sides of curtain 13.

It should be understood that Applicant has discovered a new shower curtain assembly with improved ingress/egress and water sealing characteristics. It should further be understood that this invention is not limited to the exact construction or embodiments listed and described but that various changes may be made without departing from the spirit and scope of the invention.

What is claimed is:

1. A shower curtain assembly comprising:

an elongated member which is adapted to be coupled to a top portion of a shower enclosure;

a fabric material which is coupled to said elongated member and which is adapted to selectively enclose said shower enclosure;

a weighted bottom member which is substantially coextensive with said elongated member, which is coupled to said fabric material and which provides tension to said fabric material, said bottom member having a generally flat bottom surface which is adapted to selectively and sealingly engages a horizontal surface which defines a bottom of said shower enclosure, thereby substantially preventing water from escaping from said shower enclosure;

at least one cord which is attached to said weighted bottom member and which passes through said fabric material, said at least one cord being effective to selectively and vertically raise and lower said bottom member and said fabric material; and a support assembly including a pair of selectively adjustable telescoping members on which said elongated member rests, and a pair of resilient end members which are adapted to selectively and frictionally engage a pair of walls defining said shower enclosure, thereby securing said support assembly to said shower enclosure.

2. A shower curtain assembly as in claim 1 wherein each of said telescoping members include several apertures which are effective to receive fasteners for securing said telescoping members at a desired length.

3. A shower curtain assembly as in claim 1 further comprising a pair of decorative trim members which are selectively attachable to said telescoping members, effective to conceal said telescoping members and said elongated member.

4. A shower curtain assembly as in claim 1, wherein said fabric material is mildew and bacteria resistant.

5. A shower curtain assembly as in claim 1, wherein said at least one cord is attached to at least one handle portion.

6. A shower curtain assembly as in claim 1, wherein said fabric material includes a plurality of rings, through which said at least one cord passes.

7. A shower curtain assembly as in claim 1, wherein said bottom surface is formed from a resilient material which is adapted to sealingly engage said horizontal surface.

8. A shower curtain assembly as in claim 1, wherein said at least one cord is water resistant, and wherein a locking member is disposed upon said at least one cord, said locking member being effective to engage said at least one cord and said elongated member, effective to allow said bottom member and said fabric material to be retained in a plurality of vertical positions.

9. A shower curtain assembly as in claim 1, wherein said bottom sealing surface is formed from a magnetic material which is adapted to selectively attach to said horizontal surface, thereby sealing said shower space.

10. A shower curtain assembly, comprising:

an elongated support member which is adapted to selectively engages a pair of walls defining a shower space;

a first member which rests upon said elongated support member and which includes an inner channel;

a curtain which is substantially coextensive with said first member, which is coupled to said first member and which selectively encloses said shower space;

a weighted bottom member which is substantially coextensive with said first member, which is coupled to said curtain and which provides tension to said curtain, said bottom member having a generally flat bottom surface which is adapted to selectively and sealingly engage a horizontal surface which defines said shower space, thereby substantially preventing water from escaping from said shower space; and at least one cord which is attached to said weighted bottom member and which passes through said inner channel and said curtain, said at least one cord being effective to allow a user to selectively and raise and lower said bottom member and said curtain.

11. The shower curtain assembly of claim 10, wherein said elongated support member comprises a pair of selectively adjustable telescoping tube members.

12. The shower curtain assembly of claim 11 wherein said elongated support member further comprises a pair of resilient members which are removably attachable to the ends of said pair of selectively adjustable telescoping tube members and which are adapted to frictionally engage said pair of walls defining said shower space.

13. The shower curtain assembly of claim 10 wherein said at least one cord comprises three cords.

14. The shower curtain assembly of claim 10 further comprising an adjustable member which is selectively positionable along said at least one cord, effective to allows said curtain to be retained in a plurality of vertical positions.

* * * * *